US006273425B1

(12) United States Patent
Westfall et al.

(10) Patent No.: US 6,273,425 B1
(45) Date of Patent: Aug. 14, 2001

(54) FUN HUNT YARD GAME

(76) Inventors: Lise Westfall, 476 Schwartz Rd., O' Fallon, IL (US) 62269; Lillie Beal, 2553A Brush Ct., St. Louis, MO (US) 63125

( * ) Notice: Subject to any disclaimer, the term of this patent is extended or adjusted under 35 U.S.C. 154(b) by 0 days.

(21) Appl. No.: 09/465,334

(22) Filed: Dec. 17, 1999

(51) Int. Cl.[7] ..... A63B 71/02
(52) U.S. Cl. ..... 273/459; 273/153 R
(58) Field of Search ..... 273/459, 296, 273/153 R; 283/49

(56) References Cited

U.S. PATENT DOCUMENTS 2,635,881 * 4/1953 Cooney ..... 273/153 R
2,876,012 * 3/1959 Allen, Jr. ..... 273/153 R
5,236,200 * 8/1993 McGregor et al. ..... 273/459
5,586,765 12/1996 Lackey .
5,924,695 * 7/1999 Heykoop ..... 273/459

* cited by examiner

*Primary Examiner*—Raleigh W. Chiu
(74) *Attorney, Agent, or Firm*—Don W. Weber

(57) ABSTRACT

Fun hunt is a game with instructional clues written on colored sheets of paper in a sequence from 1 to 6, followed by a final clue and a prize sheet. Each player is given a single color at the beginning of the game. The instructional clues on each color lead a player from one clue stop to the next. The clues will lead the player to objects currently in the house or yard which are separated over a distance. Clue sheets are taped to each of these objects, with each clue giving the player instructions to the next object. A final clue has a number on it which corresponds to a number on a prize. The prizes are awarded when the player follows all of the clues to the final clue and prize table. It is helpful to assist the host in creating each player's path to have a grid outlining the path which each player is to follow. It is also helpful to draw a map of the objects to assist the host in allowing distances between the objects to enable the greatest movement of the player from clue to clue.

4 Claims, 5 Drawing Sheets

| | PLAYER 1 | PLAYER 2 | PLAYER 3 | PLAYER 4 | PLAYER 5 | PLAYER 6 | PLAYER 7 |
|---|---|---|---|---|---|---|---|
| COLOR | | | | | | | |
| CLUE #1 | | | | | | | |
| CLUE #2 | | | | | | | |
| CLUE #3 | | | | | | | |
| CLUE #4 | | | | | | | |
| CLUE #5 | | | | | | | |
| CLUE #6 | | | | | | | |
| FINAL CLUE | | | | | | | |
| PRIZE NUMBER | | | | | | | |

| | PLAYER 1 | PLAYER 2 | PLAYER 3 | PLAYER 4 | PLAYER 5 | PLAYER 6 | PLAYER 7 |
|---|---|---|---|---|---|---|---|
| COLOR | | | | | | | |
| CLUE #1 | | | | | | | |
| CLUE #2 | | | | | | | |
| CLUE #3 | | | | | | | |
| CLUE #4 | | | | | | | |
| CLUE #5 | | | | | | | |
| CLUE #6 | | | | | | | |
| FINAL CLUE | | | | | | | |
| PRIZE NUMBER | | | | | | | |

Fig. 2

FUN HUNT YARD GAME

BACKGROUND OF THE INVENTION

This invention relates to the field of games. More particularly, a game is disclosed which allows a number of players to follow clues to win a prize.

There are a number of games that have been disclosed which involve moving from place to place. Often these games are designed specifically for children. However, in some instances the game can be modified by increasing the degree of difficulty for adults as well. It is an object of this invention to provide a game which may be used by children or adults, depending upon the difficulty of the clues.

A scavenger hunt is a well-known game often played. A scavenger hunt involves a player or players moving about from place to place in order to locate a series of items. When participating in a scavenger hunt, a player may go from room to room, or even house to house, in order to locate these items. However, a player does not follow any set pattern or clues but rather uses his own ingenuity to seek out places where the items on his scavenger hunt list might be located.

There are also several board games, the most prominent of which is the board game entitled "Clue" which involves solving a series of puzzles. Certain clues are disclosed to each player. It is then incumbent upon each player to solve the clues and thus to discover the answer to the ultimate puzzle. The instant device also involves clues, although they are much more direct than is usually found in board games. The player follows the clues from point to point in the instant game in order to win a prize. It is another object of this invention to provide a game which synthesizes several aspects of a scavenger hunt as well as aspects of games involving clues in order to win a prize.

Particularly when devising games for children, it is most advantageous to develop a game which involves some limited physical activity while keeping children constrained within a certain area, for example, a backyard or a house. Games like croquet, badminton, or other physical endeavors involve activity on the part of the children, but such activity might be too strenuous or inappropriate for small children. Furthermore, athletic games may simply be too difficult for one or two adults to properly supervise. It is an object of this invention to provide a game with a limited geographic scope which involves some normal physical activity but which may also be closely supervised by one or two adults.

Other and further objects of this invention will become apparent upon reading the below described Specification.

BRIEF DESCRIPTION OF THE DEVICE

The fun hunt game may be played by any number of players. In order to play the game, the host first sets out a number of clues (usually six numbered clues and a final clue) at pre-arranged locations in a backyard or house. Each set of clues are coded to a particular color. In preparing for the game, it is helpful to use a hunt grid and a map showing the objects to be located to assist in assuring that distances are obtained between objects in the consecutively numbered clues. Each clue leads the player from one position to another position in the backyard.

Each player first selects a colored clue card at the beginning of the game. That colored card directs the player to a specific location in the yard where the player finds another, consecutively numbered clue on paper of the same color as his card. That clue instructs the player to go to another location where another similarly colored clue card leads the player to another location, and so on. At the end of the hunt, a player receives a final identically colored clue card with a number on it. The player will then go to the prize table and select the prize corresponding to the number on his final clue. Any number of players can participate in the fun hunt, and each player is awarded a prize at the end of the fun hunt.

BRIEF DESCRIPTION OF THE DRAWING FIGURE

The Drawing

FIG. 2 depicts the player's grid utilized in preparing the game to be played.

DETAILED DESCRIPTION OF THE PREFERRED EMBODIMENT

Figure 1:
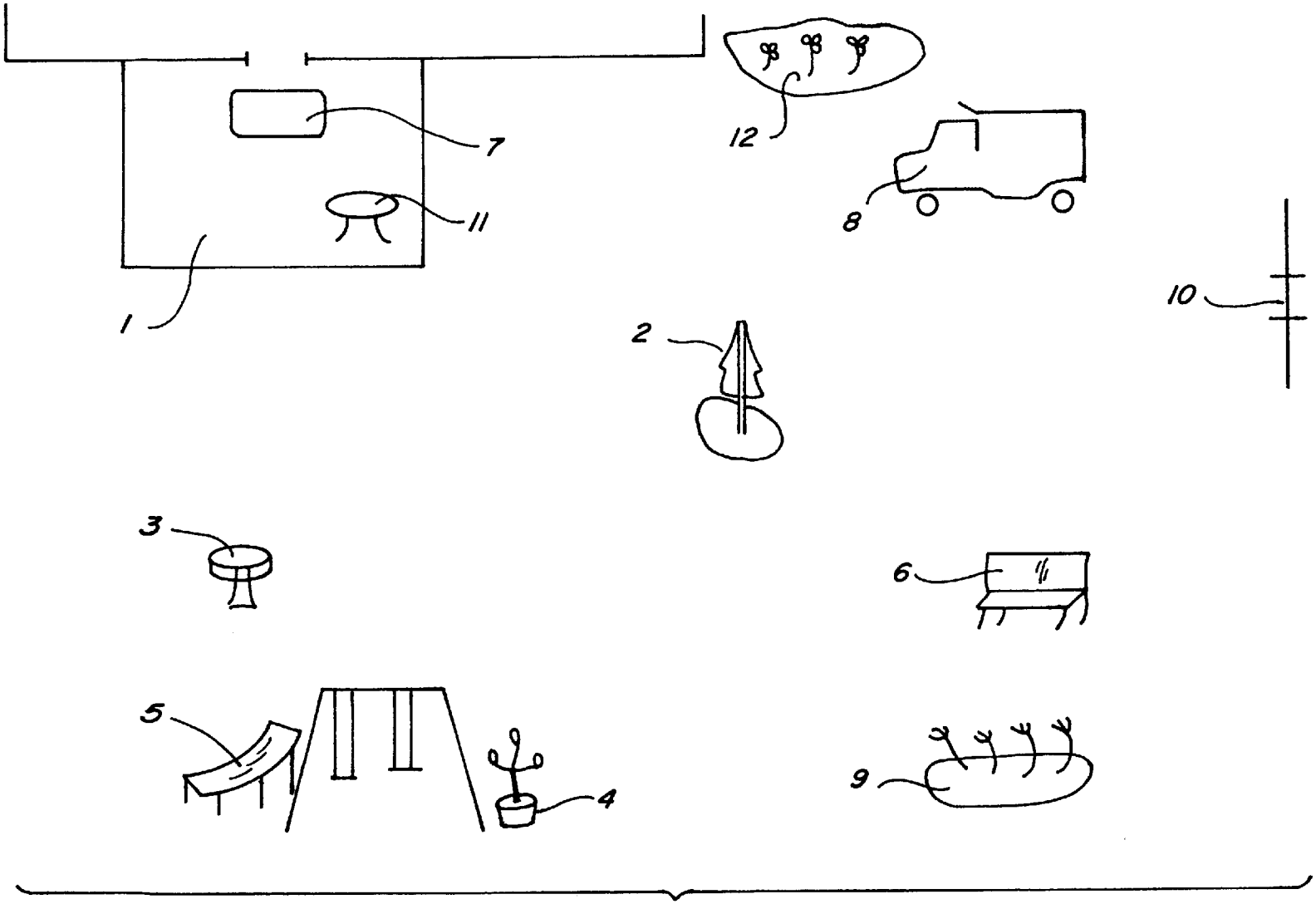
FIG. 1 illustrates a map disclosing the objects to be located in playing the Fun Hunt Game.

The fun hunt game is easy to play and may accommodate any number of players. The standard fun hunt packet has enough individually colored clue sheets for seven players. However, packets in different colors can also be used if more than seven players will be involved in the game. The fun hunt may be played in either the house or the yard or in any other limited geographic location desired.

The fun hunt game has a number of instructional clues written on colored sheets of papers in sequence. There are normally six clues followed by a final fun hunt clue and a prize sheet.

Each player is given a single color, corresponding to the consecutively numbered and identically colored clues located about the objects throughout the yard. The instructional clues on each color will lead a player from one clue stop to the next. Clues refer to objects currently in the house and yard such as the table on the porch, the maple tree, the bed of pansies, the back gate, or the bird bath.

In preparing for the game, a grid as shown in FIG. 2 is used to assist the host in creating each player's path. It is also helpful to use a sheet of paper on which is drawn a map (FIG. 1) with the objects used in the game to assure that distances are obtained between the objects, allowing the greatest movement of each player from clue to clue.

A typical grid sheet would be arranged as follows:

| | Birthday Fun Hunt ™ Player 1 | Birthday Fun Hunt ™ Player 2 | Birthday Fun Hunt ™ Player 3 | Birthday Fun Hunt ™ Player 4 | Birthday Fun Hunt ™ Player 5 | Birthday Fun Hunt ™ Player 6 | Birthday Fun Hunt ™ Player 7 |
|---|---|---|---|---|---|---|---|
| Color of Birthday Fun Hunt ™ Clue Sheet | Blue | Green | Orange | Yellow | Pink | Red | Purple |
| Birthday Fun Hunt ™ Clue #1 | Go to the maple tree. | Go to the birdbath. | Go to the flowerpot under the swing set. | Go to the swing set slide. | Go to the green bench. | Go to the back porch under the doormat. | Go to the toy dump truck. |
| Birthday Fun Hunt ™ Clue #2 | Go to the bed of pansies. | Go to the back gate. | Go to the birdbath. | Go to the table on the deck. | Go to the doormat. | Go to the yellow daisy bed. | Go to the table on the deck. |
| Birthday Fun Hunt ™ Clue #3 | Go to the back porch under the doormat. | Go to the yellow daisy bed. | Go to the table on the deck. | Go to the yellow daisy bed. | Go to the maple tree. | Go to the birdbath. | Go to the back gate. |
| Birthday Fun Hunt ™ Clue #4 | Go to the green bench. | Go to the back porch under the doormat. | Go to the swing set slide. | Go to the back gate. | Go to the flowerpot under the swing set. | Go to the bed of pansies. | Go to the yellow daisy bed |
| Birthday Fun Hunt ™ Clue #5 | Go to the swing set slide. | Go to the maple tree. | Go to the back gate. | Go to the green bench. | Go to the birdbath. | Go to the green bench. | Go to the table on the deck. |
| Birthday Fun Hunt ™ Clue #6 | Go to the birdbath. | Go to the bed of pansies. | Go to the yellow daisy bed. | Go to the toy dump truck. | Go to the bed of pansies. | Go to the swing set slide. | Go to the green bench. |
| Birthday Fun Hunt ™ Final Clue | Go to the flowerpot under the swing set. | Go to the toy dump truck. | Go to the back porch under the doormat. | Go to the table on the deck. | Go to the yellow daisy bed. | Go to the maple tree. | Go to the back porch under the doormat. |
| Birthday Fun Hunt ™ Prize Number | #1 | #2 | #3 | #4 | #5 | #6 | #7 |

Once the grid has been prepared, the host or hostess will write clues on consecutively numbered sheets leading the player from one object to another. Each player has a specific color for his clues, so that he or she knows only to take the next numbered clue corresponding to his particular color. The host will have taped these consecutively numbered sheets to the corresponding objects, or clue stops, in order, prior to the beginning of the game.

FIG. 1 shows a schematic display of a backyard which is being prepared for the fun hunt game. The backyard would comprise a back porch 1, a maple tree 2, a birdbath 3, a flower pot under the swing set 4, a slide by the swing set 5, a green bench 6, a doormat on the porch 7, a toy dump truck 8, a bed of pansies 9, a back gate 10, a table on the deck 11 and a yellow daisy bed 12. By setting up this grid before writing out the clues, one could easily make the path of travel of each player cover a great distance. For example, Player 2 would start on the back porch and go to the bird bath first. That player would then traverse the length of the yard by going from the bird bath 3 to the back gate 10. The clue on the back gate 10 would lead the player to the yellow daisy bed 12, then to the doormat on the back porch 7, then to the maple tree 2, then to the bed of pansies 9, and then to the toy dump truck 8. As can be seen, that player has thus walked back and forth across the yard. The clues can lead the player on a walk crisscrossing the yard.

Once the final numbered clue has been reached a final hunt clue will be located on the last object with a number on it. The number on the final clue will correspond to a number on a prize at the prize table. The prizes may be wrapped in special corresponding wrapping paper or they may be individually wrapped and numbered. Each player has one color throughout the game and selects his prize based on a number given on his final clue.

In preparing this fun hunt game, the hostess should first draw a map of the backyard or house, indicating the objects that will be used in the fun hunt game. The hostess should map the pathway of travel for each player to insure there is a distance between the objects. Moving a small area (20 to 30 feet) is better exercise for the contestant and it has been shown that each player has more fun in participating in the game when the objects are separated by some distance.

Figure 3:
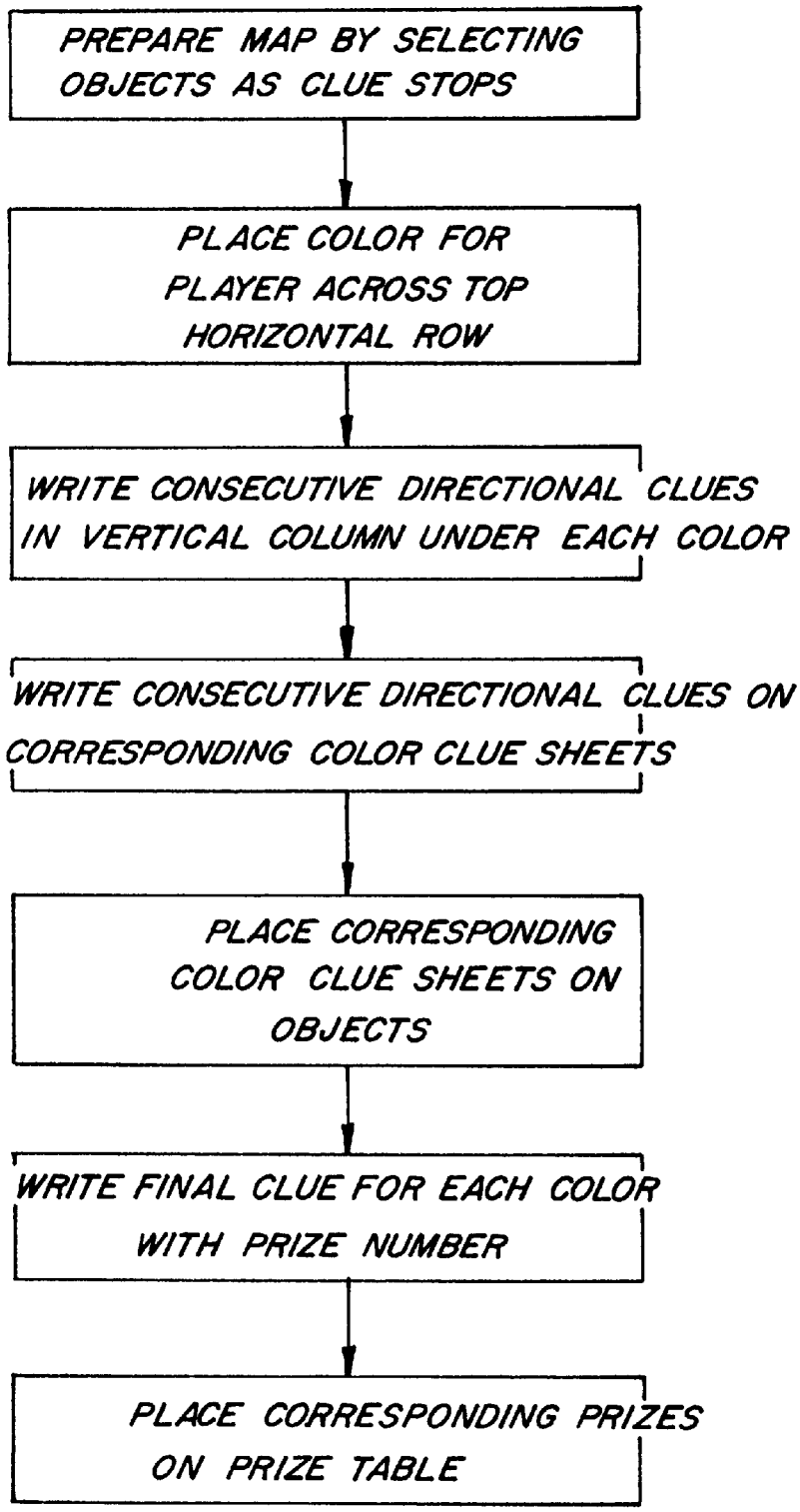
FIG. 3 is a flow chart depicting the method used to play the game.

A map of the playing area showing the fun hunt objects also makes it easier to prepare the fun hunt pathway grid and clues. The steps for preparing the game are shown schematically in FIG. 3.

Figure 5:
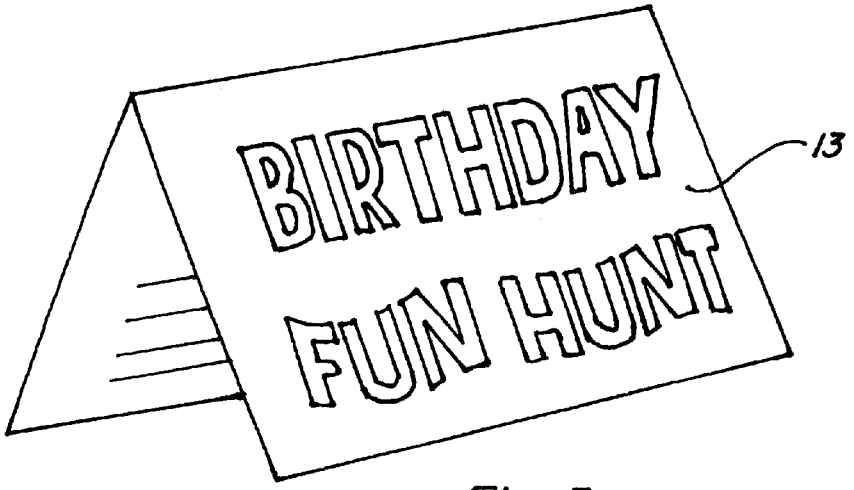
FIG. 5 is a perspective view of a typical clue sheet.
Figure 6:
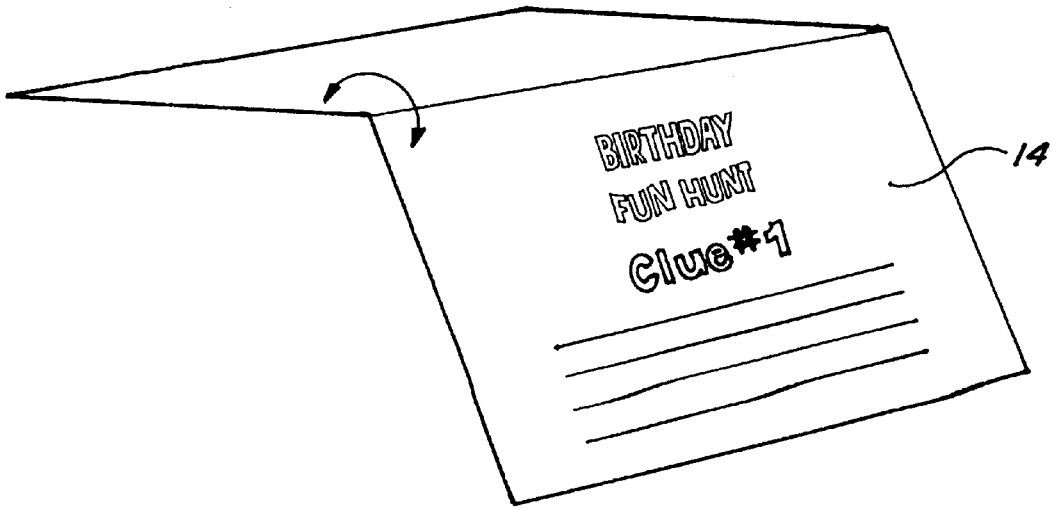
FIG. 6 is a perspective view of the inside of a typical clue sheet.

To begin the game, each of the players reaches into a container and pulls out one of the separately colored clue sheets. The clue sheet will signify the player's color, as well as giving him the clue to the next object to be found. Each clue has a front cover 13, as shown typically in FIG. 5. Underneath this cover 13 is a clue page 14, as typically shown in FIG. 6. The clue sheets could be in a different form, however, FIGS. 5 and 6 show a typical clue sheet used in playing the game. If the first clue reads "Go to the maple tree", the player will then go to the maple tree and remove the corresponding colored sheet #2 and read it. That sheet will say "Go to the birdbath". At the birdbath, the player will find where the host has previously placed clue sheet #3, and so on until the final clue sheet is reached. When the player finds the final clue sheet, it will instruct the player to go find the prize number on the prize table. The player will then choose the prize on the prize table that has his corresponding number. This procedure is repeated for all of the different colors and all of the different players.

As an example, a fun hunt player #1 will have selected the color blue as his particular color for the game. As one goes down the column for the blue player, one sees that he will first be instructed to go to the maple tree. He will then be instructed to go to the bed of pansies, then to the doormat, then to green bench, then to the swing set slide, then to the birdbath, and then to the flowerpot under the swing set. Once he reaches the final clue (at the flowerpot under the swing set) he will be instructed to go the prize table and to receive prize #1. Prize #1 will be numbered and may also be wrapped in corresponding blue wrapping paper.

Fun Hunt player #2 chose the green color. His clues will lead him ultimately to the toy dump truck 8 where he will find his final clue and prize number.

Players #1 through #7 will thus be crisscrossing the back yard shown in the Drawing Figure in order to follow the clue from place to place.

Figure 4:
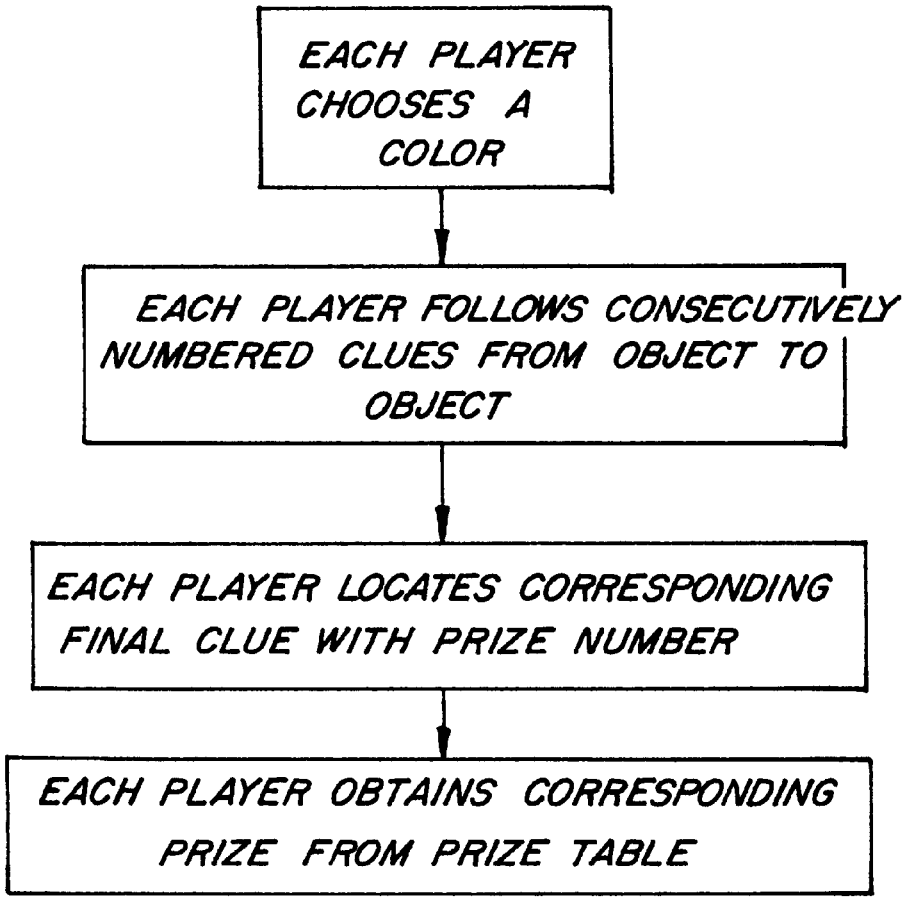
FIG. 4 is a flow chart depicting the method used in playing the game.

The steps for playing the game are shown schematically in FIG. 4.

Although this game appears to create something of a competition between the players, in reality each player will ultimately win a designated prize when he finishes his hunt through the various clues. However, it has been found in practice that this game creates a great deal of excitement, especially among youngsters, and they will move as rapidly as possible through the clues in order to reach the final prize.

The game may be shortened by simply leaving out the final clues, usually by omitting clues #5 and #6. The final hunt clue is purposely not numbered making it easy to move from fun hunt clue #4 to the final clue. However, Clues #5 and #6 may also be included in a longer game. Since the final clue is not numbered, the game may be played with any number of consecutive clues prior to the final clue.

The game may also be played inside the house by simply using all of the instructions above but replacing the objects in the yard with objects in different rooms in the house.

The fun hunt game may be utilized using one player or any number of players. The only requirement with respect to the number of players is that separately numbered packages for Clues #1 through #6 and the final clue be made available. Once the colored coded clues are posted, the game may begin with as many players as are desired.

This particular fun hunt game may be individualized for particular holidays. For example, a St. Patrick's Day Fun Hunt, a Valentine's Day Fun Hunt, a Bunny Fun Hunt (for Easter), a Spooky Fun Hunt (for Halloween), or a New Year's Eve Hunt may be organized. In organizing these particular hunts, specialized colored paper may be used utilizing different colors but displaying a particular design, such as a Christmas Scene, a St. Patrick's Day Scene or a New Year's Eve Scene, for example.

The fun hunts can also be used for fund raising projects (Fund Fun Hunt) for a pajama party, for a garden party, a summer party, a baby shower, wedding or graduation.

Furthermore, specialized wrapping paper, invitations, color balloons, napkins, paper plates and cups may also be coordinated with this game in order to establish the colors in the player's mind as well as to provide a more festive event.

Obviously, minor variations of this game can be utilized while still keeping within the disclosure of this invention. For example, any number of players can participate, lettered packets could be substituted for color packets (Player A would have all of his clues with the letter A on the clue), and the clues could be expanded or contracted in number. All of these variations are still within the concept and disclosure of this devise.

Having fully described my invention, We claim:

1. Game paraphernalia for playing a hunting game, comprising:

(1) A player's grid consisting of vertical and horizontal columns used to diagram each player's clues and movements wherein said grid contains directions to objects on a game map;

(2) A game map showing the actual objects to be located during the game:

(3) A plurality of colored clue sheets located on the objects depicted in said map, wherein each player's clue sheets have the same color and wherein the color of each player's clue sheets are different from each other player's color.

2. A method of preparing a hunting game to be played, comprising the steps of:

(1) preparing a map of the playing area and selecting objects in the area to be used as clue stops;

(2) placing a color for each player across a grid sheet and writing consecutive directional clues vertically under each color;

(3) writing the corresponding clue on the corresponding consecutive clue sheets;

(4) placing the corresponding clue sheets on the corresponding objects in the playing area;

(5) writing a final clue for each color and placing a corresponding prize number in the final clue;

(6) placing the prizes on the prize table corresponding to the number on the final clue.

3. A method of playing a hunting game, comprising the steps of:

(1) For each player, choosing a color corresponding to previously placed clues, wherein each clue has the same color as the corresponding player's color;

(2) For each player, following consecutive corresponding colored clues from object to object, wherein each consecutive clue directs the player to the next object;

(3) For each player, locating a final clue having directions and a number, wherein said directions instruct the player to go to a prize table and wherein the number corresponds to a prize;

(4) For each player, obtaining the prize from the prize table.

4. A method of preparing a hunting game to be played as in claim 2, wherein the clues may be distinguished by corresponding letters on the clues rather than by corresponding colors.

* * * * *